US005450905A

United States Patent [19]

Brammer et al.

[11] Patent Number: 5,450,905

[45] Date of Patent: Sep. 19, 1995

[54] PRESSURE ASSIST INSTALLATION OF PRODUCTION COMPONENTS IN WELLHEAD

[75] Inventors: Norman Brammer, Aberdeen, England; James Gariepy, Houston, Tex.

[73] Assignee: ABB Vetco Gray Inc., Houston, Tex.

[21] Appl. No.: 294,702

[22] Filed: Aug. 23, 1994

[51] Int. Cl.[6] ..... E21B 33/043

[52] U.S. Cl. ..... 166/348; 166/123; 166/208; 166/382; 166/387

[58] Field of Search ..... 166/348, 382, 387, 208, 166/182, 123; 285/139, 140

[56] References Cited

U.S. PATENT DOCUMENTS

| | | | |
|---|---|---|---|
| 4,003,434 | 1/1977 | Garrett et al. | 166/120 X |
| 4,540,053 | 9/1985 | Baugh et al. | 166/348 |
| 4,880,061 | 11/1989 | Ahlstone | 166/348 |
| 4,969,519 | 11/1990 | Kelly | 166/348 |
| 5,000,266 | 3/1991 | Saunders et al. | 166/208 X |
| 5,044,442 | 9/1991 | Nobileau | 166/382 |
| 5,080,174 | 1/1992 | Hynes | 166/382 |
| 5,372,201 | 12/1994 | Milberger | 166/382 |

*Primary Examiner*—Hoang C. Dang
*Attorney, Agent, or Firm*—James E. Bradley

[57] ABSTRACT

A method of installing a wellhead component such as a tubing hanger or tree cap utilizes hydraulic pressure to move the component downward. A blowout preventer is connected to the production tree. The component has a primary metal seal and an elastomeric installation seal. The component is lowered on drill pipe through the blowout preventer into the tree bore with the installation seal sealingly engaging the bore. The primary seal is in a run-in position prior to setting. The operator closes the blowout preventer and pumps liquid through a kill line into the annular chamber below the blowout preventer. This causes the component to move downward, deforming the primary seal into the sealing engagement with the bore and the component.

21 Claims, 5 Drawing Sheets

PRESSURE ASSIST INSTALLATION OF PRODUCTION COMPONENTS IN WELLHEAD

BACKGROUND OF THE INVENTION

1. Field of the Invention

This invention relates in general to wellhead completion procedures, in particular to a method of installing a tubing hanger and internal tree cap in a wellhead using pressure assist methods.

2. Description of the Prior Art

In a typical offshore wellhead installation, upper and lower casing hangers will be suspended in the wellhead housing, each connected to a string of casing. Casing hanger seals will seal the annulus around each casing hanger to the bore of the wellhead housing. Tubing is lowered through the smaller diameter string of casing and supported by a tubing hanger. The tubing hanger in one type of installation lands and seals to the wellhead housing, using various types of running tools and seals. A production tree then lands on the wellhead housing for controlling through valves production fluids produced through the tubing. The production tree may be subsea or at the surface and connected by a tieback connection to a wellhead at the sea floor.

In another and recent type of offshore installation, known as a horizontal tree, the production tree is landed on the wellhead housing before the tubing hanger is installed. The tubing hanger is lowered into the tree and seals in the bore of the production tree. The tubing hanger and production tree have lateral flow passages which register with each other for producing the production fluids. A crown plug is installed in the tubing hanger and a tree cap installed on the tree. The horizontal production tree may be located subsea or at the production platform. Various types of seals are employed to seal between the tubing hanger and the bore of the production tree and tree cap and production tree. Various running tools are employed to install the tubing hanger, seals and tree cap.

Metal seals are desirable for offshore wellheads in general because of the longer life as compared to elastomeric seals. Metal seals, however, require a much higher setting force. Metal seals in general are normally set in offshore wellheads by using a hydraulic running tool. The hydraulic running tool is lowered on drill pipe through a blowout preventer which mounts to the wellhead. The hydraulic running tool may receive hydraulic fluid through a separate line for actuating a piston to set the metal seal. Alternately, the hydraulic running tool may be operated by pressure supplied to the annulus below the blowout preventer.

In one type of running tool used for running casing hanger metal annulus seals, the running tool has a bulk elastomeric seal that seals in the wellhead housing. The blowout preventer is closed on the drill pipe. Hydraulic pressure is supplied down a choke and kill line to the annulus around the drill pipe between the blowout preventer and the bulk seal. The running tool has a piston that causes setting of the casing hanger seal. While successful, these hydraulically actuated running tools for supplying forces for setting metal seals are fairly complex and expensive.

SUMMARY OF THE INVENTION

In this invention, a new method and apparatus are employed for installing components in a wellhead using the assistance of hydraulic pressure. The bore of the production tree, also sometimes referred to herein as wellhead, is provided with a primary seal surface, an installation seal surface, and a stop shoulder located at the lower end of the primary seal surface. A riser is connected from the production tree to the production vessel or platform. The riser includes a blowout preventer and a choke and kill line which has an inlet located between the blowout preventer and the upper end of the production tree.

The component to be installed, which may be a tubing hanger or tree cap, is provided with a primary seal surface, an annular metal primary seal, and an annular elastomeric installation seal. The tubing hanger is connected to drill pipe and lowered into the well. Once the primary seal contacts the stop shoulder in the bore of the tree, further downward movement will temporarily stop. The installation seal in this position will have sealingly engaged the installation seal surface in the bore of the tree.

The operator then closes the blowout preventer around the drill pipe and applies hydraulic pressure through the choke and kill line. Closure of the blowout preventer creates a sealed annular chamber surrounding the drill pipe between the blowout preventer and the tubing hanger installation seal. The pressure then forces the tubing hanger downward. The metal primary seal is unable to move further downward because of being supported by the stop shoulder. The downward force of the tubing hanger deforms the metal seal into sealing engagement. Preferably, the deformation is radial due to an interference fit between the tubing hanger and the inner diameter of the primary seal.

In a horizontal tree installation, there will be two metal seals employed, one below the lateral flow passage and one above. These seals simultaneously set as the tubing hanger moves to the lower position. Once in the lower position, the running tool is disconnected and the drill pipe removed. A crown plug is installed in the axial flow passage of the tubing hanger.

The internal tree cap is installed in a similar manner. It also has a primary seal and an installation seal. The drill pipe will lower the internal tree cap through the blowout preventer and into the upper bore of the tree. The operator applies hydraulic fluid pressure which acts against the installation seal on the internal tree cap. The pressure forces the tree cap downward, deforming the primary seal which is supported by the stop shoulder.

DETAILED DESCRIPTION OF THE INVENTION

Figure 1A:
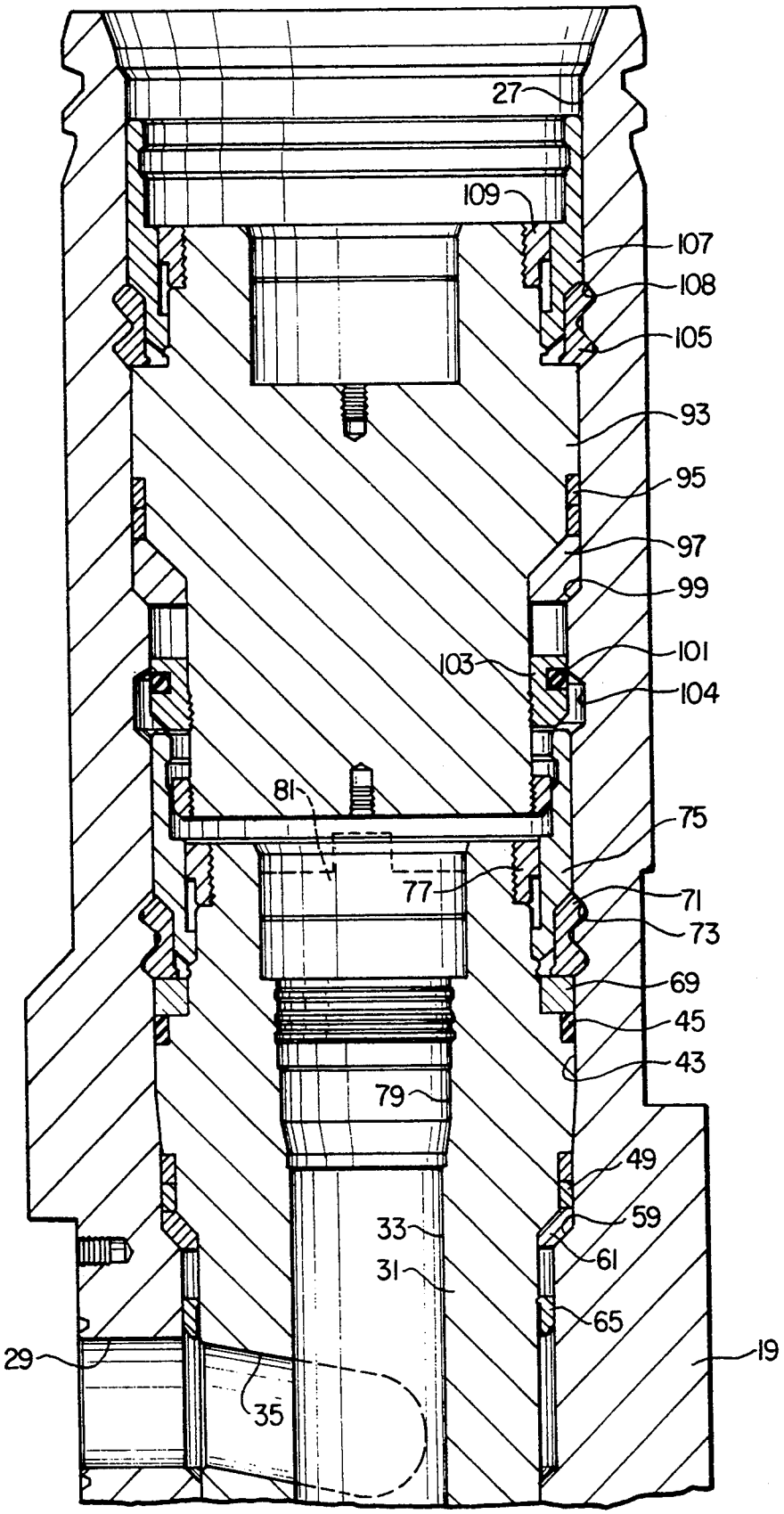
FIGS. 1A and 1B comprise a vertical sectional view of a wellhead assembly constructed in accordance with this invention, with the components shown in a final set position.
Figure 1B:
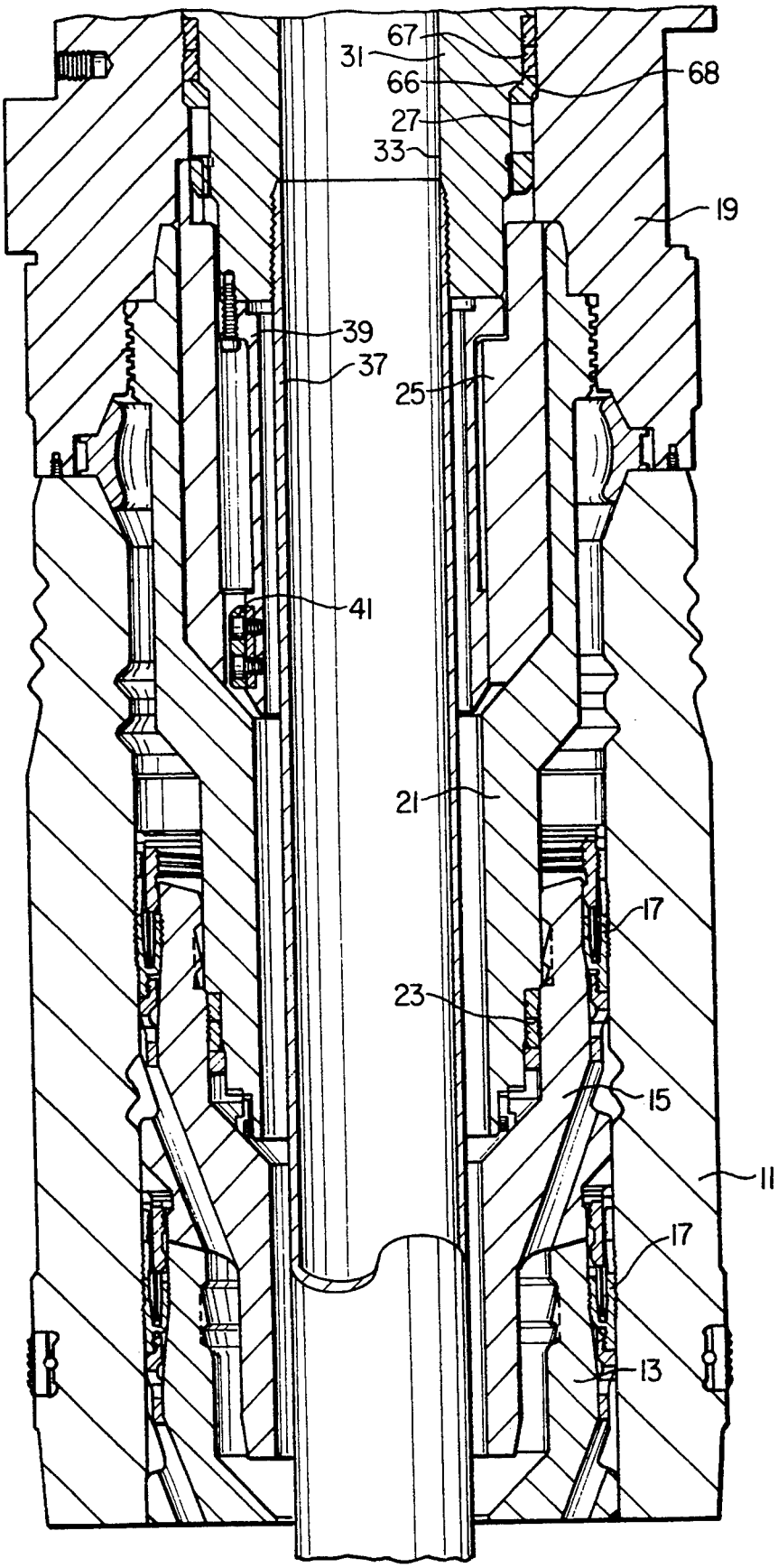

Referring to FIGS. 1A and 1B, the wellhead assembly includes a high pressure wellhead housing 11. In the example shown, wellhead housing 11 is located subsea and is supported on the sea floor by a low pressure housing which is not shown. Wellhead housing 11 supports within it a lower casing hanger 13 and an upper casing hanger 15. Conventional seals 17 seal the casing hangers 13, 15 to the bore of wellhead housing 11. Each casing hanger 13, 15 is located at the upper end of a string of casing which extends into and is cemented within the well.

In the embodiment shown, a production tree 19 of a horizontal type mounts to the upper end of wellhead housing 11. Tree 19 has an extension sub 21 on its lower end that extends down into engagement with the bowl of the upper casing hanger 15. A metal seal 23 seals extension sub 21 to the bowl of upper casing hanger 15. Extension sub 21 has a muleshoe or orienting sleeve 25 mounted within it which has a helical guide slot. Orienting sleeve 25 is locked in a selected position relative to tree 19.

Tree 19 has an axial bore 27 extending completely through it. A lateral flow passage 29 (FIG. 1A) extends laterally out the side wall of tree 19 between its upper and lower ends. A tubing hanger 31 lands in tree bore 27 after tree 19 has been installed on wellhead housing 11. Tubing hanger 31 has an axial bore 33 that is coaxial with tree bore 27. Tubing hanger 31 has a lateral flow passage 35 that will register with tree flow passage 29 for the production of fluids flowing out of bore 33. A string of tubing 37 secures to the lower end of tubing hanger 31 and extends into the well to the production zones. Tubing hanger 31 has an orienting insert 39 secured to its lower end. Orienting insert 39 has an orienting key 41 that will engage the helical slot in the orienting sleeve 25 to properly orient tubing hanger 31 relative to tree 19.

Tree bore 27 has a portion which may be considered an installation seal surface 43. An installation seal 45 will mount into tubing hanger 31 will sealingly engage installation seal surface 43. Installation seal 45 is an elastomeric seal that serves only in the installation procedure. Although it continues to seal after installation, it is not needed for that purpose, rather it is used only temporarily.

Figure 2:
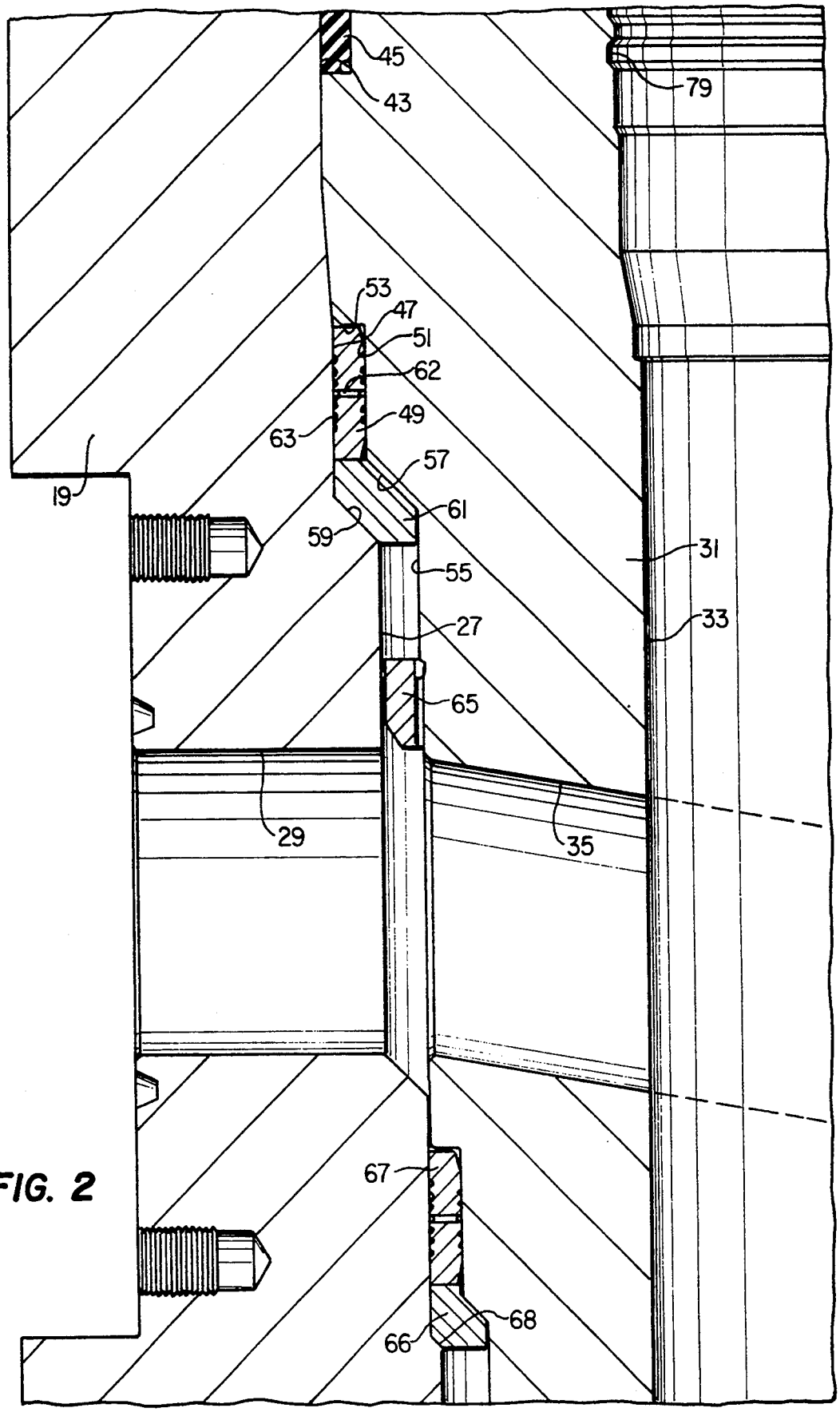
FIG. 2 is an enlarged partial sectional view of a portion of the wellhead assembly of FIG. 1.

Referring now to FIG. 2, tree bore 27 also has an upper primary seal surface 47 which is located below installation seal surface 43. In the embodiment shown, upper primary seal surface 47 is slightly smaller in diameter than installation seal surface 43 (FIG. 1A). A metal upper primary seal 49, preferably of steel, will sealing engage upper primary seal surface 47. Upper primary seals 49 seals on its inner diameter to an upper primary seal surface 51 on the tubing hanger. A primary seal surface shoulder 53 faces downward from the upper end of tubing hanger upper primary seal surface 51.

A recess 55 locates below upper primary seal surface 51 and is of a lesser diameter. A recess shoulder 57, which is conical, separates upper primary seal surface 51 from recess 55. An upper stop shoulder 59 is formed in tree bore 27 and faces upward at the same angle as recess shoulder 57. A support ring 61 is adapted to land on upper stop shoulder 59. Support ring 61 slidingly engages recess 55, with it being initially held in a lower run-in position by a retainer ring 65. Retainer ring 65 is stationarily secured to tubing hanger 31.

Upper primary seal 49 is a solid metal member, except for the optional test passage 62 that may extend through it laterally. Upper primary seal 49 has an initial radial thickness from its inner diameter to its outer diameter that is initially greater than the radial distance between the upper primary seal surfaces 47, 51. Also, the inner diameter of primary seal 49 is less than the outer diameter of tubing hanger upper primary seal surface 51. Additionally, the outer diameter of upper primary seal 49 is initially smaller than the inner diameter of bore upper primary seal surface 47. Inlays 63 of soft metal such as tin and indium are preferably placed in circumferential grooves both on the inner and outer diameters of the primary seal 49.

Figure 3:
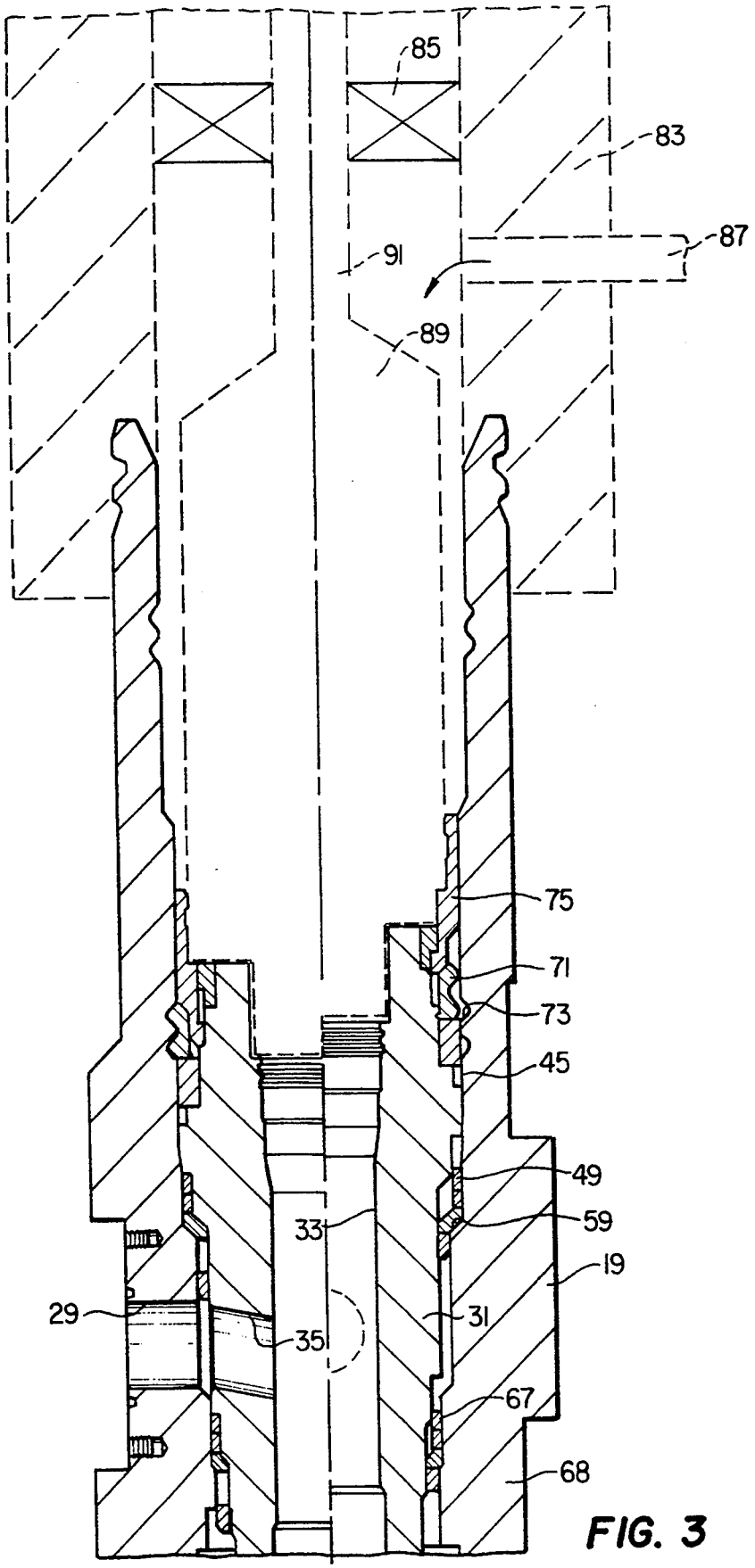
FIG. 3 is a sectional view of a portion of the wellhead assembly of FIG. 1, illustrating the procedure for installing the tubing hanger, with the tubing hanger being shown at an initial upper position on the right side of drawing and in the final set position on the left side of the drawing.

Upper primary seal 49 is initially carried in the lower position shown in the right side of FIG. 3 in the recess 55. When support ring 61 contacts stop shoulder 59 and tubing hanger 31 is moved further downward, upper primary seal 49 will be forced into the pocket formed between the bore upper primary seal surface 47 and the tubing hanger upper primary seal surface 51. Tubing hanger upper primary seal surface 51 radially deforms the primary seal 49 outward into an interference fit. The outer wall of primary seal 49 sealingly engages the bore upper primary seal surface 47 as well as the tubing hanger upper primary seal surface 51.

Referring again to FIG. 1A, upper primary seal 49 locates above lateral flow passages 29, 35. Referring to FIG. 1B, a lower primary seal 67 locates below lateral flow passages 29, 35. Lower primary seal 67 is identical to upper primary seal 49, except for dimensions and is therefore is not explained in detail. The discussion above applies as well, including the use of a lower support ring 66 which engages a lower stop shoulder 68. Similarly, the extension sub seal 23 (FIG. 1B) is preferably identical to the primary seals 49, 67, except for dimensions and the manner of installation.

Referring again to FIG. 1A, installation seal 45 is held in place by a threaded retainer ring 69. A lock ring 71 locates above retainer ring 69. Lock ring 71 is a split ring that will move between expanded and contracted positions shown in FIG. 3. When expanded, lock ring 71 engages grooves 73 formed in bore 27 of tree 19. An energizing ring 75 when moved downward, wedges lock ring 71 to the outer position. Energizing ring 75 is carried by tubing hanger 31 by means of a retainer ring 77. A series of grooves 79 are formed in the upper end of tubing hanger bore 33. Grooves 79 are positioned to receive a crown plug 81 which may be a conventional member that may be installed by a wire line tool (not shown).

Referring still to FIG. 3, a conventional blowout preventer assembly 83 will be connected to the upper end of production tree 19. Blowout preventer assembly 83 includes a blowout preventer 85. A choke and kill line 87 extends from the vessel or production platform at the surface down to a point below blowout preventer 85. A running tool 89 is shown connected to energizing ring 75 for lowering the tubing hanger 31 in place. A lower central depending portion of running tool 89 locates sealingly within an upper portion of tubing hanger bore 33 above grooves 79.

Running tool 89 may be of various types and is supported on a string of conduit, preferably drill pipe 91. Preferably, running tool 89 is of a type that has a separate hydraulic line (not shown) leading from the production platform for the purpose of moving energizing ring 75 downward to push lock ring 71 outward into groove 73. Running tool 89 will then release itself from energizing ring 75. Running tool 89 does not have the ability, however, to set the primary seals 49 and 67 by moving tubing hanger 31 from the initial upper position shown on the right side of FIG. 3 to the set position shown on the left side of FIG. 3.

In the installation of tubing hanger 31, tubing 37 will be assembled into a string and connected to tubing hanger 31. Running tool 89 will be connected to energizing ring 75 and its lower end inserted sealingly into the upper end of tubing hanger bore 33. Crown plug 81 will not be in bore 33 at this point, rather is installed after tubing hanger 31 is set. Drill pipe 91 will be connected to running tool 89. The assembly is then lowered into the well through the bore 27 of tree 19.

Downward movement will stop when support rings 61, 66 engage the stop shoulders 59, 68. The engagement is approximately at the same time, although due to tolerances, may not be precisely simultaneous. The interference of the inner diameters of the primary seals 49, 67 with the tubing hanger 31 prevents further downward movement. At this point, the elastomeric installation seal 45 will have engaged the installation seal surface 43.

The operator then closes the blowout preventer 85 around the drill pipe 91. The operator then pumps liquid under pressure through choke and kill line 87. A sealed chamber is formed in the interior of blowout preventer assembly 83 surrounding drill pipe 91, with the upper end of the chamber being the blowout preventer 85 and the lower end of the chamber being the installation seal 45. The pressure acts against the tubing hanger 31, causing it to move downward a short distance, along with the running tool 89 and drill pipe 91. The blowout preventer 85 continues to seal even though the drill pipe 91 slides downward a short distance. The pressure causes the primary seals 49 and 67 to radially deform and seal as shown on the left side of FIG. 3. Once fully set, there need be no axial compression on the primary seals 49, 67. Preferably a clearance exists between the shoulder 53 and the upper end of upper primary seal 49. A similar clearance exists in connection with lower primary seal 67. The weight or downward force on tubing hanger 31 transmits through the support rings 61, 66 to the stop shoulders 59, 68 and to the tree 19.

The operator releases hydraulic pressure and actuates running tool 89 by its separate hydraulic line (not shown) to cause energizing ring 75 to move downward and push lock ring 71 into engagement with groove 73. The operator opens blowout preventer 85 and retrieves running tool 89. The operator will then install crown plug 81 in a conventional manner such as by wireline.

Figure 4:
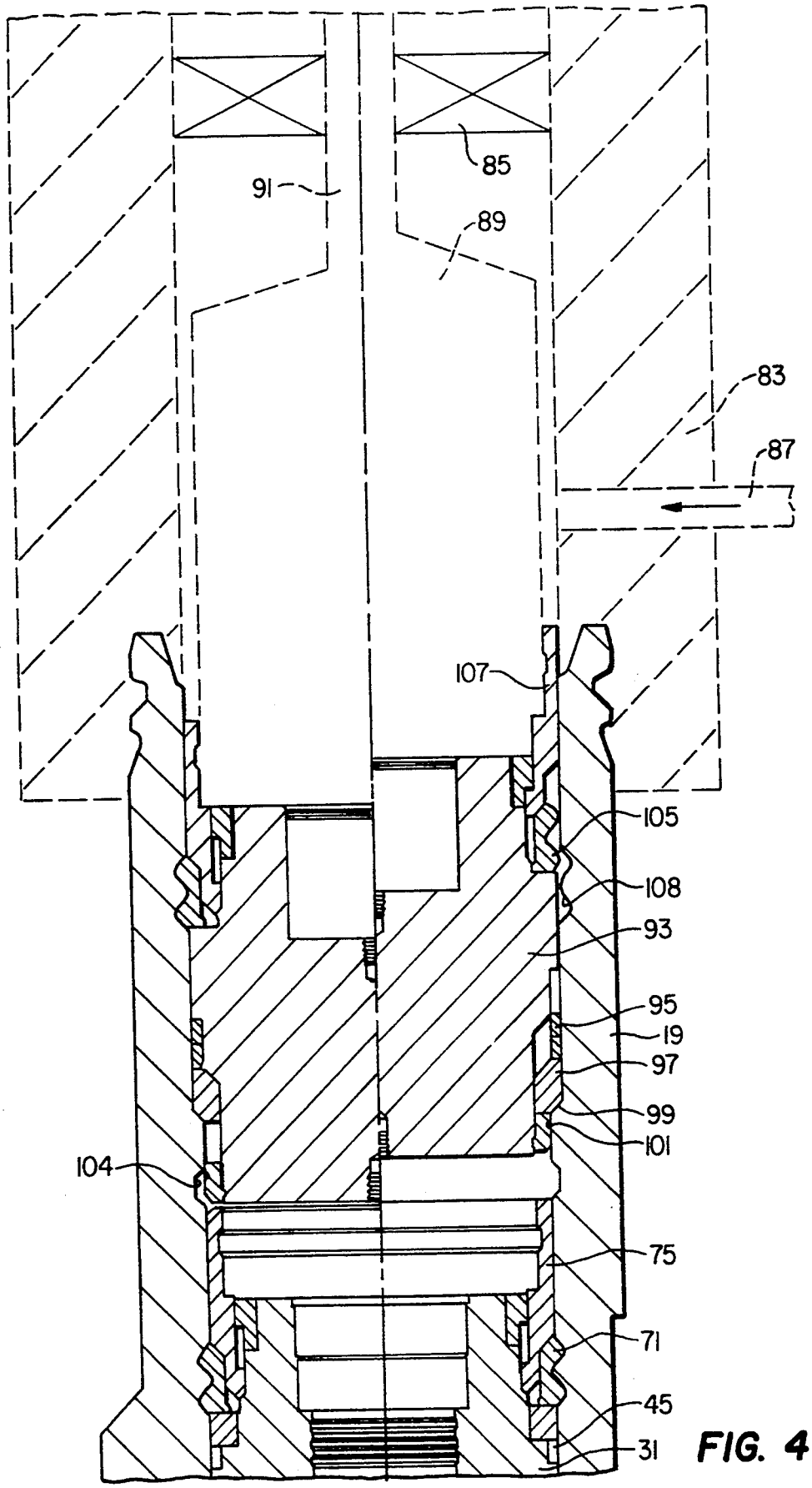
FIG. 4 is a sectional view illustrating installation of the internal tree cap for the wellhead assembly of FIG. 1, with the right side showing the tree cap in an initial upper position, and the left side in the final set position.

The wellhead assembly is now in position for receiving a tree cap 93, shown in FIG. 1A. Tree cap 93 locates internally within the bore 27 of tree 19. Tree cap 93 has a primary seal 95 that is identical to the tubing hanger seals 49, 67 except for dimensions. Primary seal 95 is supported by a support ring 97 which is adapted to land on a stop shoulder 99. Support ring 97 is slidable on the tree cap 93 between the positions of the right and left sides of FIG. 4. Primary seal 95 is set in the same manner as tubing hanger seals 49, 67.

An installation seal 101 mounts to tree cap 93, preferably below primary seal 95. Installation seal 101 serves only for setting the primary seal 95 and has no further sealing function after the setting of seal 95. To assure that is does not seal after installation, a relief groove 104 is formed in tree bore 27. When tree cap 93 reaches its final set position, installation seal 101 will reach relief groove 104 so as to prevent any further sealing of installation seal 101. Installation seal 101 is shown to be an o-ring mounted within a metal retainer ring 103 which is secured by threads stationarily to tree cap 93. Retainer ring 103 also supports support ring 97 in its lower run-in position.

Tree cap 93 has a similar locking means comprising an expandable lock ring 105. An energizing ring 107 will expand lock ring 105 outward into grooves 108. Retainer 109 secures energizing ring 107 to tree cap 93.

In the installation of tree cap 93, running tool 89 will be secured to energizing ring 107 and the assembly lowered down through riser and through blowout preventer assembly 83. When support ring 97 contacts stop shoulder 99, as shown on the right side of FIG. 4, further downward movement is prevented. Installation seal 101 will be sealingly engaging the bore 27 directly below the stop shoulder 99 and above relief groove 104. The operator then closes blowout preventer 85 on drill pipe 91 and applies hydraulic pressure to choke and kill line 87. A closed chamber will thus exist between installation seal 101 and blowout preventer 85. The pressure forces tree cap 93 downward. Primary seal 9.5 deforms radially outward in the same manner as discussed in connection primary seals 49, 67.

Liquid will be trapped between the installation seal 101 and primary seal 95, but hydraulic lock is avoided. The volume of space above support ring 97 when in the lower position shown on the right side of FIG. 4, equals the volume of space that exists between installation seal 101 and support ring 97 when in the set position shown on the left side of FIG. 4. The inner diameter of bore 27 directly below stop shoulder 99 equals the outer diameter of the primary seal surface which receives primary seal 95. Therefore, the volume for trapped fluid does not change between the initial position and the set position. There is no trapped liquid between tree cap 93 and tubing hanger 31 due to an additional flow passage (not shown) through tree 19 approximately at lock ring 71.

After lock ring 105 has been placed into engagement with the grooves 108 by actuating running tool 89, the operator disengages running tool 89 with energizing ring 107 and retrieves running tool 89.

The invention has significant advantages. By using annulus hydraulic pressure on the wellhead component to deform the metal seals, a complex hydraulically actuated running tool is not required. The installation seals on the components are inexpensive. The choke and kill line and blowout preventer are required for completion operations of a conventional nature and will therefore be available.

While the invention has been shown in only two of its forms, it should be apparent to those skilled in the art that it is not so limited but is susceptible to various changes without departing from the scope of the invention.

We claim:

1. A method of installing a wellhead component within an axial bore of a wellhead assembly, the method comprising:

providing the bore with a primary seal surface, an installation seal surface, and a stop shoulder located at a lower end of the primary seal surface;

connecting a blowout preventer assembly which includes a blowout preventer to the wellhead assembly, and providing the blowout preventer assembly with a kill line extending to an inlet between the blowout preventer and the wellhead assembly;

providing the component with a primary seal surface, an annular metal primary seal, and an annular elastomeric installation seal;

lowering the component on a conduit through the blowout preventer assembly and into an initial upper position within the wellhead assembly with the installation seal sealingly engaging the installation seal surface and the primary seal supported by the stop shoulder; then closing the blowout preventer around the conduit to create a sealed annular chamber around the conduit between the installation seal and the blowout preventer;

pumping a liquid through the kill line into the annular chamber at a pressure sufficient to cause downward sliding movement of the conduit relative to the blowout preventer and downward sliding movement of the component relative to the stop shoulder, to deform the primary seal into sealing engagement with the primary seal surfaces of the component and the bore; then disconnecting the conduit from the component and retrieving the conduit with the component remaining in the wellhead assembly.

2. The method according to claim 1 wherein the step of providing the component with a primary seal comprises mounting the primary seal to the component in a run-in position spaced axially from the primary seal surface, and the step of causing downward movement of the component relative to the stop shoulder causes the primary seal surface of the component to move downward relative to the primary seal.

3. The method according to claim 1 wherein the step of providing the component with a primary seal comprises:

providing an inner diameter for the primary seal that is less than an outer diameter of the primary seal surface of the component;

mounting the primary seal to the component in a run-in position spaced from the primary seal surface of the component; and wherein the step of causing downward movement of the component relative to the stop shoulder causes the primary seal surface of the component to move downward relative to the primary seal and to deform the primary seal radially outward.

4. The method according to claim 1 wherein the component comprises a tubing hanger which is secured to a string of tubing.

5. The method according to claim 1 wherein the component comprises an internal tree cap.

6. The method according to claim 1, further comprising:

mounting a locking element to the component;

providing a locking groove in the bore; and moving the locking element into the locking groove after the primary seal has set.

7. A method of installing a wellhead component within an axial bore of a wellhead assembly, the method comprising:

providing the bore with a primary seal surface, an installation seal surface, a stop shoulder located at a lower end of the primary seal surface, and a locking groove;

connecting a blowout preventer assembly which includes a blowout preventer to the wellhead assembly, and providing the blowout preventer assembly with a kill line extending to an inlet between the blowout preventer and the wellhead assembly;

providing the component with a primary seal surface having an outer diameter, a recess extending downward from the primary seal surface and having a lesser outer diameter than the primary seal surface;

mounting an annular metal primary seal to the component in the recess, and providing the primary seal with an inner diameter that is less than the outer diameter of the primary seal surface;

mounting an annular elastomeric installation seal to the component;

mounting a locking element to the component;

lowering the component on a conduit through the blowout preventer assembly and into an initial upper position within the wellhead assembly with the installation seal sealingly engaging the installation seal surface and the primary seal supported by the stop shoulder; then closing the blowout preventer around the conduit to create a sealed annular chamber around the conduit between the installation seal and the blowout preventer;

pumping a liquid through the kill line into the annular chamber at a pressure sufficient to cause downward sliding movement of the conduit relative to the blowout preventer and downward sliding movement of the component relative to the stop shoulder and the primary seal, to radially deform the primary seal into sealing engagement with the primary seal surface of the component and the bore; then moving the locking element into the locking groove; and disconnecting the conduit from the component and retrieving the conduit with the component remaining in the wellhead assembly.

8. The method according to claim 7 wherein the component comprises a tubing hanger which is secured to a string of tubing.

9. The method according to claim 7 wherein the component comprises an internal tree cap.

10. A method of installing a tubing hanger within an axial bore of a wellhead assembly, the method comprising:

providing the bore with a primary seal surface, an installation seal surface, a stop shoulder located at a lower end of the primary seal surface, and a locking groove;

connecting a blowout preventer assembly including a blowout preventer to the wellhead assembly, and providing the blowout preventer assembly with a kill line extending to an inlet between the blowout preventer and the wellhead assembly;

providing the tubing hanger with a primary seal surface, an annular metal primary seal, and an annular elastomeric installation seal;

mounting a locking element to the tubing hanger;

connecting a lower end of the tubing hanger to a string of production tubing and an upper end of the tubing hanger to a conduit, and lowering the tubing hanger on the conduit through the blowout preventer and into an initial upper position within the wellhead assembly with the installation seal sealingly engaging the installation seal surface and the primary seal supported by the stop shoulder; then closing the blowout preventer around the conduit to create a sealed annular chamber around the conduit between the installation seal and the blowout preventer;

pumping a liquid through the kill line into the annular chamber at a pressure sufficient to cause downward sliding movement of the conduit relative to the blowout preventer and downward sliding movement of the tubing hanger relative to the stop shoulder, to deform the primary seal into sealing engagement with the primary seal surface of the tubing hanger and the bore; then moving the locking element into engagement with the locking groove; then disconnecting the conduit from the tubing hanger and retrieving the conduit with the tubing hanger remaining in the wellhead assembly.

11. The method according to claim 10 wherein the step of providing the tubing hanger with a primary seal comprises:

providing a recess below the primary seal surface of the tubing hanger and providing an inner diameter for the primary seal that is less than an outer diameter of the primary seal surface of the tubing hanger and greater than an outer diameter of the recess;

mounting the primary seal to the tubing hanger in a run-in position in the recess; and wherein the step of causing downward movement of the tubing hanger relative to the stop shoulder causes the primary seal surface of the tubing hanger to move downward relative to the primary seal and to deform the primary seal radially outward.

12. The method according to claim 11 wherein the step of providing the tubing hanger with an installation seal comprises positioning the installation seal above the primary seal.

13. A method of installing a tree cap within an axial bore of a production tree from an offshore platform, the method comprising:

providing the bore with a primary seal surface, an installation seal surface, a stop shoulder located at a lower end of the primary seal surface, and a locking groove;

connecting a blowout preventer assembly including a blowout preventer to the production tree, and providing the blowout preventer with a kill line extending to an inlet between the blowout preventer and the production tree;

providing the tree cap with a primary seal surface, an annular metal primary seal, and an annular elastomeric installation seal;

mounting a locking element to the tree cap;

connecting the tree cap to a conduit and lowering the tree cap on the conduit through the blowout preventer and into an initial upper position within the production tree with the installation seal sealingly engaging the installation seal surface and the primary seal supported by the stop shoulder; then closing the blowout preventer around the conduit to create a sealed annular chamber around the conduit between the installation seal and the blowout preventer; then pumping a liquid through the kill line into the annular chamber at a pressure sufficient to cause downward sliding movement of the conduit relative to the blowout preventer and downward sliding movement of the tree cap relative to the stop shoulder, to deform the primary seal into sealing engagement with the primary seal surfaces of the tree cap and the bore; then moving the locking element into engagement with the locking groove; then disconnecting the conduit from the tree cap and retrieving the conduit with the tree cap remaining in the production tree.

14. The method according to claim 12 wherein the step of providing the tree cap with a primary seal comprises:

providing a recess below the primary seal surface of the tree cap and providing an inner diameter for the primary seal that is less than an outer diameter of the primary seal surface of the tree cap and greater than an outer diameter of the recess;

mounting the primary seal to the tree cap in a run-in position in the recess; and wherein the step of causing downward movement of the tree cap relative to the stop shoulder causes the primary seal surface of the tree cap to move downward relative to the primary seal and to deform the primary seal radially outward.

15. The method according to claim 14 wherein the step of providing the tree cap with an installation seal comprises positioning the installation seal below the primary seal and relieving the installation seal from further sealing after the primary seal has set.

16. A method of installing a tubing hanger within an axial bore of a production tree, the method comprising:

providing the production tree with a lateral flow passage extending from the bore through a sidewall, and providing a locking groove in the bore;

providing the bore with an upper primary seal surface and an upper stop shoulder at a lower end of the primary seal surface, both located above the lateral flow passage, and a lower primary seal surface and a lower stop shoulder at a lower end of the lower primary seal surface, both located below the lateral flow passage;

providing the bore with an installation seal surface;

connecting a blowout preventer assembly including a blowout preventer to the production tree, and providing the blowout preventer assembly with a kill line extending to an inlet between the blowout preventer and the production tree;

providing the tubing hanger with a lateral flow passage extending through a sidewall;

providing the tubing hanger with an upper primary seal surface having an outer diameter, an upper recess extending downward from the upper primary seal surface of the tubing hanger and having a lesser outer diameter than the upper primary seal surface of the tubing hanger, the upper primary seal surface of the tubing hanger and upper recess being located above the lateral flow passage of the tubing hanger;

providing the tubing hanger with a lower primary seal surface having an outer diameter, a lower recess extending downward from the lower primary seal surface of the tubing hanger and having a lesser outer diameter than the lower primary seal surface of the tubing hanger, the lower primary seal surface of the tubing hanger and lower recess being located below the lateral flow passage of the tubing hanger;

mounting an annular metal upper primary seal to the tubing hanger in the upper recess, and providing the upper primary seal with an inner diameter that is less than the outer diameter of the upper primary seal surface of the tubing hanger;

mounting a lower primary seal to the tubing hanger in the lower recess, and providing the lower primary seal with an inner diameter that is less than the outer diameter of the lower primary seal surface of the tubing hanger;

mounting an annular elastomeric installation seal to the tubing hanger;

mounting a locking element to the tubing hanger;

connecting the tubing hanger to string of tubing and lowering the tubing hanger on the conduit through the blowout preventer, orienting the lateral flow passages with each other, and positioning the tubing hanger in an initial upper position within the production tree with the installation seal sealingly engaging the installation seal surface and the upper and lower primary seals supported by the upper and lower stop shoulders, respectively; then closing the blowout preventer around the conduit to create a sealed annular chamber around the conduit between the installation seal and the blowout preventer;

pumping a liquid through the kill line into the annular chamber at a pressure sufficient to cause downward sliding movement of the conduit relative to the blowout preventer and downward sliding movement of the tubing hanger relative to the stop shoulders, causing the primary seal surfaces of the tubing hanger to radially deform the primary seals into sealing engagement with the primary seal surfaces of the tubing hanger and the bore; then moving the locking element into the locking groove; and disconnecting the conduit from the tubing hanger and retrieving the conduit with the tubing hanger remaining in the production tree.

17. The method according to claim 16 wherein the step of mounting the installation seal comprises mounting the installation seal to the tubing hanger above the primary seals.

18. A wellhead assembly, comprising in combination:

a wellhead having a bore with a primary seal surface, an installation seal surface, and a stop shoulder located at a lower end of the primary seal surface;

a blowout preventer assembly connected to the wellhead and having a blowout preventer and a kill line extending to an inlet between the blowout preventer and the wellhead;

a component having a primary seal surface, an annular metal primary seal, and an annular elastomeric installation seal;

means for connecting the component to a conduit, and for lowering the component on the conduit through the blowout preventer and into an initial upper position within the wellhead with the installation seal sealingly engaging the installation seal surface and the primary seal supported by the stop shoulder; and means pumping a liquid into the kill line while the blowout preventer is closed around the conduit at a pressure sufficient to cause downward sliding movement of the conduit relative to the blowout preventer and downward sliding movement of the component relative to the stop shoulder, to deform the primary seal into sealing engagement with the primary seal surfaces of the component and the bore.

19. The wellhead assembly according to claim 18 wherein the component is a tubing hanger.

20. The wellhead assembly according to claim 18 wherein the component is a tree cap.

21. The wellhead assembly according to claim 18 wherein the primary seal surface of the component moves downward relative to the primary seal when the component moves downward after the initial upper position, deforming the primary seal radially outward.

* * * * *